US006213822B1

(12) United States Patent
Saito et al.

(10) Patent No.: US 6,213,822 B1
(45) Date of Patent: Apr. 10, 2001

(54) TILT AND TRIM UNIT FOR MARINE DRIVE

(75) Inventors: Hideki Saito; Daisuke Nakamura, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/234,091

(22) Filed: Jan. 19, 1999

(30) Foreign Application Priority Data

Jan. 19, 1998 (JP) ..... 10-021381
Jan. 19, 1998 (JP) ..... 10-021382

(51) Int. Cl.[7] ..... B63H 20/08
(52) U.S. Cl. ..... 440/61
(58) Field of Search ..... 440/61

(56) References Cited

U.S. PATENT DOCUMENTS 3,983,835 * 10/1976 Hall ..... 440/61
4,121,736 10/1978 McGaw, Jr. .
4,419,083 * 12/1983 Taguchi ..... 440/56
4,493,659 * 1/1985 Iwashita ..... 440/61
4,521,202 6/1985 Nakahama .
4,545,769 10/1985 Nakahama et al. .
4,551,104 11/1985 Iwashita et al. .
4,575,342 3/1986 Nakahama et al. .
4,605,377 8/1986 Wenstadt .
4,784,625 11/1988 Nakahama .
4,925,411 5/1990 Burmeister et al. .
4,944,705 7/1990 Kashima et al. .
5,358,436 * 10/1994 Soda et al. ..... 440/61
5,368,509 11/1994 Tsujii .
5,489,226 * 2/1996 Nakamura et al. ..... 440/61
5,643,021 7/1997 Osakabe .

FOREIGN PATENT DOCUMENTS 59-153693 9/1984 (JP) .
60-116592 6/1985 (JP) .

* cited by examiner

*Primary Examiner*—S. Joseph Morano
*Assistant Examiner*—Andrew Wright
(74) *Attorney, Agent, or Firm*—Knobbe, Martens, Olson & Bear, LLP

(57) ABSTRACT

A tilt and trim unit for a marine drive eases manual trim or tilt up of the drive, while presenting a compact construction. The unit includes a cylinder having upper and lower fluid chambers. A bypass arrangement selectively bypasses a shock absorbing mechanism of the tilt and trim unit. The bypass arrangement is formed by a sub-chamber and a valve positioned in series on one side of the fluid chambers. This arrangement produces a compact construction. The valve also desirably establishes three operating states for the tilt and trim unit. In one state, the valve is open and the tilt and trim unit is easily moved. In another state, the valve is closed to prevent movement of the tilt and trim unit. In a third state, the valve operates as a one-way valve permitting extension of the tilt and trim unit to raise the marine drive, but inhibiting retraction of the tilt and trim unit. This latter operating state allows a person to raise the outboard motor and then close the valve without having to continuously hold the outboard motor when closing the valve.

28 Claims, 6 Drawing Sheets

TILT AND TRIM UNIT FOR MARINE DRIVE

BACKGROUND OF THE INVENTION

1. Field of the Invention

This invention relates to a marine propulsion unit for a watercraft, and more particularly to a tilt and trim unit for a marine propulsion unit.

2. Description of the Related Art

Outboard motors with four-cycle engines have grown in popularity in recent years, due in part to environmental concerns associated with two-cycle outboard motors. The application of four-cycle engines in outboard motors, however, has raised some challenges, especially with large horse power engines. A four-cycle engine will weigh more than a two-cycle engine that produces a comparable horsepower to that of the four-cycle engine. The additional weight creates problems for the conventional hydraulic tilt and trim units used with the outboard motor.

A tilt and trim unit commonly operates between components of a clamping assembly to adjust the trim and tilt position of the outboard motor. In particular, the tilt and trim unit usually includes an extendable hydraulic cylinder, piston assembly that operates between a clamping bracket and a swivel bracket of the clamping assembly, which typically supports an outboard motor on a watercraft. The clamping bracket is attached to the watercraft and the swivel bracket supports the outboard motor. A pivot pin connects together the swivel and clamping brackets. Extension of a rod of the cylinder causes the swivel bracket to pivot about the axis of the pivot pin, relative to the stationary clamping bracket, to raise or lower the outboard drive. This assembly prevents the outboard motor from popping up when operating in reverse, while permitting the outboard motor to pop up when it strikes an underwater object as it travels forward.

Manually operated tilt and trim units usually include a bypass passage that interconnects chambers of the cylinder which the piston separates. A valve assembly is located within the passage to regulate flow through the passage. When the valve assembly is opened, the outboard motor can be manually tilted up without having to act against the resistance of the hydraulic cylinder. U.S. Pat. No. 4,784,625 entitled "Tilt Lock Mechanism For Marine Propulsion Device," illustrates an exemplary arrangement of the valve assembly and bypass passage of a tilt and trim unit. The tilt lock mechanism disclosed in the '625 patent includes a separate accumulator chamber that communicates with the two chambers of the hydraulic cylinder. Check valves normally restrict flow between the cylinder chambers and the accumulator chamber. An actuating mechanism selectively opens one of the check valves or the other to permit manual movement of the outboard motor, either up or down, without working against the hydraulic cylinder.

FIG. 1 illustrates another prior construction of a hydraulic cylinder, piston assembly 20, in cross-section. The prior cylinder 20 includes a piston 22 that slides within a bore 24 of the cylinder 20. The piston 22 divides the bore 24 into upper and lower fluid chambers 26, 28.

A piston rod 30 is attached to the piston 22 and extends beyond one end of the cylinder 20, through the upper chamber 26. The outer end of the piston rod 30 includes a trunnion 32 that is pivotally attached to an associated swivel bracket. The cylinder body 20 also includes a lower trunnion 34 that is pivotally connected to the associated clamping bracket.

A passage 36 extends generally parallel and next to the cylinder bore 24, on one side of the cylinder 20, and connects together the upper and lower fluid chambers 26, 28. A manual valve 38 operates within the passage 36 to control the flow of working fluid through the passage 36. When the valve 38 is open, the upper and lower fluid chambers 26, 28 communicate with each other through the passage 36, and the piston 22 can be easily slid within the bore 24. The outboard motor thus can be raised and lowered, unencumbered by the hydraulic cylinder assembly 20. When the valve 38 is closed, however, the hydraulic cylinder assembly 20 locks the outboard motor in the established tilt or trim position. An actuator 39 is used to open and close the valve 38.

As seen in FIG. 1, the cylinder assembly 20 also includes an accumulation chamber 40 arranged on one side of the cylinder bore 24. The accumulation chamber 40 communicates with the lower fluid chamber 28 of the cylinder 20 to compensate for the volumetric differences between the upper and lower fluid chambers 26, 28. That is, because the piston rod 30 extends through the upper chamber 26, and thus reduces the volume in the upper chamber 26, less fluid will be displaced from the upper chamber 26 than is required to make up the volume in the lower chamber 28 as the piston 22 moves upwardly. The accumulation chamber 40 directly communicates with the lower fluid chamber 28 to compensate for this volumetric difference between the fluid chambers 26, 28. The accumulation chamber 40 is arranged on a side of the cylinder bore 24 opposite of the passage 36 and the manual valve 38.

Another prior cylinder assembly for a tilt locking mechanism is illustrated in U.S. Pat. No. 5,368,509, issued Nov. 29, 1994, and entitled "Tilt Lock System For Outboard Motor." The construction of this assembly is generally similar to the cylinder assembly construction illustrated in FIG. 1, but with a multi-position valve located on the same side of the cylinder as the accumulation chamber and interposed between these components of the cylinder assembly.

The constructions of both tilt and trim units, illustrated in FIG. 1 and disclosed in the '509 patent, result in a wide assembly. The swivel and clamping consequently must be wide and reinforced to accommodate the hydraulic cylinder assembly. The increased weight of the new four-cycle outboard motors further exacerbates this problem, requiring additional reinforcement of the brackets. Such reinforcing increases the size and weight of the brackets, as well as increases the manufacturing cost.

An additional prior construction of a hydraulic cylinder assembly 50 is illustrated in FIG. 2, which depicts the cylinder assembly in cross-section. In this cylinder assembly 50, an accumulation chamber 52 is integrated into an upper fluid chamber 54 above a port 56 that communicates with the upper fluid chamber 54. FIG. 2 illustrates the position of a piston 58 and piston rod 60 in a fully retracted position. Under this condition, a volume of working fluid F1 remains above the piston 58 with a volume of inert compressible gas F2 residing above the working fluid F1 to form the accumulation chamber 52 above the upper fluid chamber 54.

The width of the tilt and trim unit illustrated in FIG. 2 is less than the width of the unit illustrated in FIG. 1; however, the length of the unit increases as a result of the location of the accumulation chamber above the piston. In order for the unit to fit between the clamping and swivel brackets with the outboard motor in a fully trimmed down position, the size of the accumulation chamber must be reduced. A smaller accumulation chamber consequently reduces the diameter size of the piston. And a smaller size piston reduces the amount of weight the hydraulic unit can support so that the unit cannot be used with heavy outboard motors.

In addition, both the cylinder assembly designs illustrated in FIGS. 1 and 2 are difficult to adjust, especially when supporting a heavy motor. In both prior designs, the manual valve is opened to tilt up the outboard motor. If the person adjusting the trim position wants to close the valve once the outboard motor has been raised to the desired position, the user cannot simply let go of the outboard motor as it will immediately lower (i.e., trim or tilt down) under its own weight. The person thus must hold the heavy outboard motor while leaning over the transom of the watercraft to close the valve. This operation is difficult and awkward for one person to perform alone.

SUMMARY OF THE INVENTION

A need therefore exists for a compact tilt and trim unit of a minimal width which is capable of supporting heavier outboard motors and which eases manually trimming and tilting up of the outboard motor.

One aspect of the present invention thus involves a compact tilt and trim unit. The tilt and trim unit comprises an actuator including a first variable volume fluid chamber and a second variable volume fluid chamber. A piston, which moves along a stroke axis of the actuator, separates the first and second fluid chambers. The chambers communicate with each other through a valve mechanism. A sub-chamber is connected to the first fluid chamber. The sub-chamber and the valve mechanism are arranged next to the actuator on the same side of the actuator stroke axis and directly above one another. In one mode, the valve mechanism is arranged next to the second fluid chamber, and the sub-chamber is arranged next to the first fluid chamber below the valve mechanism. This construction produces a compact arrangement without sacrificing the size of the sub-chamber.

Another aspect of the invention involves a tilt and trim unit for a marine drive comprising a cylinder. The cylinder includes a first variable-volume fluid chamber and a second variable-volume fluid chamber separated by a movable piston. A sub-chamber freely communicates with the first fluid chamber and communicates with the second fluid chamber through a valve mechanism. The sub-chamber includes a volume of working fluid and a volume of compressible fluid occupying a space above the working fluid. Both the first and second chambers of the cylinder communicate with the sub-chamber at a point below an interface surface between working fluid and the compressible fluid. In one mode, a conduit, which extends generally parallel to an axis of the cylinder, extends through a portion of the space occupied by the compressible fluid and connects the second fluid chamber to the sub-chamber at a point below the interface surface.

In accordance with another aspect of the present invention, a tilt and trim unit includes an improved valve assembly that eases manual trim and tilt up of an associated marine drive. The tilt and trim unit also includes a cylinder having a first variable-volume fluid chamber and a second variable-volume fluid chamber, which are separated by a movable piston. The first and second fluid chambers communicate with each other through a passage. The valve assembly is positioned within the passage to establish at least a plurality of flow conditions through the passage. The valve assembly includes first and second valves, each valve including a valve seat and a valve element biased against the corresponding valve seat. The valves of the assembly are positioned such that a common biasing member acts upon the valve elements. The valves are also arranged such that the first valve inhibits fluid flow through the passage in a first flow direction which is opposite to a second flow direction inhibited by the second valve.

In a preferred mode, the valve assembly additionally comprises a valve actuator. The valve actuator includes a first rotational cam member that cooperates with the valve element of the first valve to move the valve element between an open position and a closed position. The valve actuator also includes a second rotational cam member that cooperates with the valve element of the second valve to move the valve element between an open position and a closed position. The first cam member and the second cam member preferably are arranged to establish three flow conditions through the passage: (1) a closed flow condition in which the valve elements of both valves are simultaneously in the closed position; (2) a one-way flow condition in which the valve element of one valve is open and the valve-element of the other valve is closed; and (3) an open flow condition in which the valve elements of both valves are simultaneously in the open position.

Further aspects, features, and advantages of the present invention will become apparent from the detailed description of the preferred embodiments which follows.

BRIEF DESCRIPTION OF THE DRAWINGS

As noted above.

FIG. 3 is a side elevational view of an outboard motor supported on a transom of a watercraft by a tilt and trim system configured in accordance with the preferred embodiment of the present invention.

FIG. 4 is a front elevational view of the tilt and trim system of FIG. 3 as viewed in the direction of arrow A.

FIG. 5 is cross-sectional view of a cylinder assembly of the tilt and trim system of FIG. 3, and illustrates a main cylinder, a sub-cylinder and a manually controlled valve assembly of the cylinder assembly.

FIG. 6A schematically illustrates a first cam member and associated components of the valve assembly of FIG. 5 in a closed state. FIG. 6B schematically illustrates a second cam member and associated components of the valve assembly of FIG. 5 in the closed state. And FIG. 6C is an enlarged, partial sectional view of the valve assembly of FIG. 5, taken normal to the first and second cam members, with the valve assembly in the closed state.

FIG. 7A schematically illustrates the first cam member and associated components of the valve assembly of FIG. 5 in a one-way state. FIG. 7B schematically illustrates the second cam member and associated components of the valve assembly of FIG. 5 in the one-way state. And FIG. 7C is an enlarged, partial sectional view of the valve assembly of FIG. 5, taken normal to the first and second cam members, with the valve assembly in the one-way state.

FIG. 8A schematically illustrates the first cam member and associated components of the valve assembly of FIG. 5 in an open state. FIG. 8B schematically illustrates the second cam member and associated components of the valve assembly of FIG. 5 in the open state. And FIG. 8C is an enlarged, partial sectional view of the valve assembly of FIG. 5, taken normal to the first and second cam members, with the valve assembly in the open state.

DETAILED DESCRIPTION OF THE PREFERRED EMBODIMENT

Figure 1:
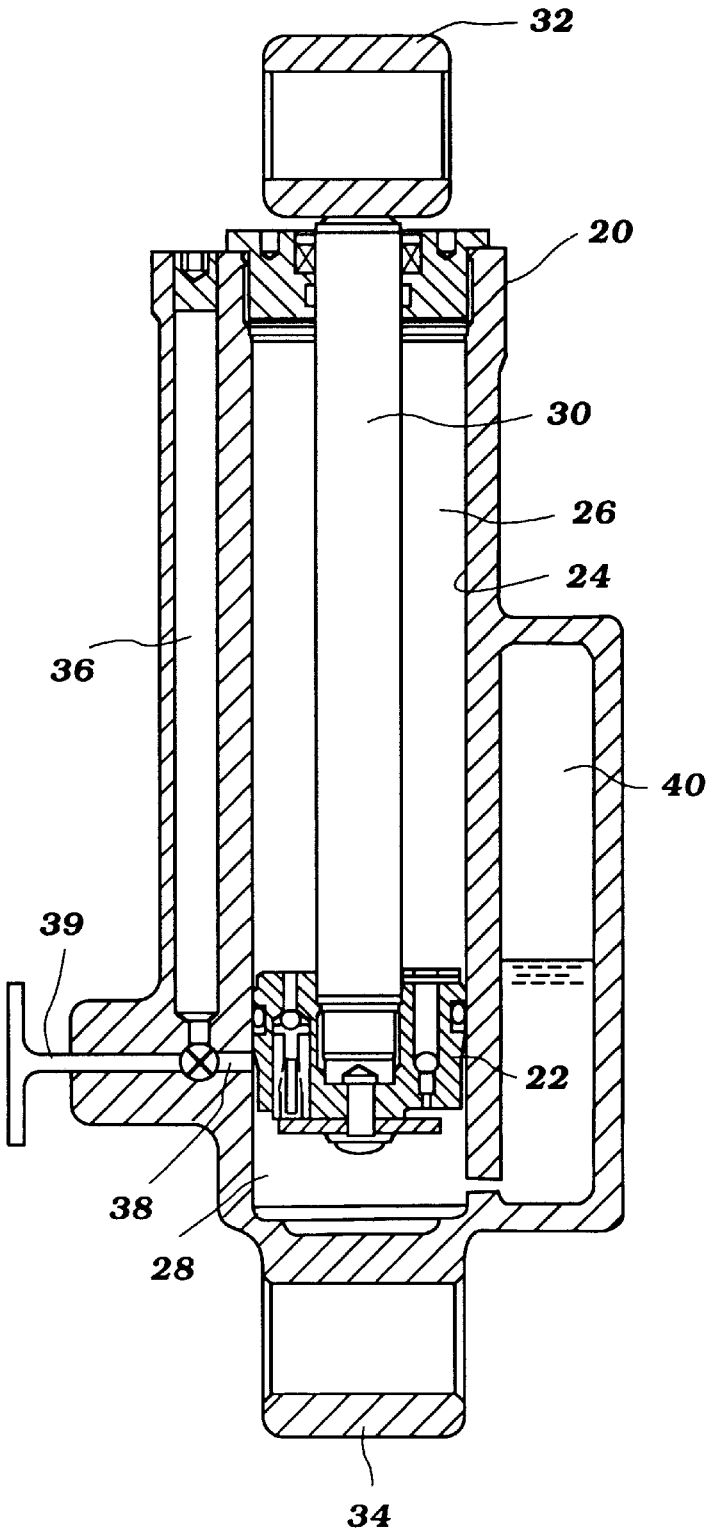
Figure 1 Prior Art
FIGS. 1 and 2 illustrate prior tilt and trim units used with small size outboard motors. These figures are provided in order to assist the reader's understanding of the prior art and for the reader to better appreciate the aspects, features, and advantages associated with the present invention.
Figure 2:
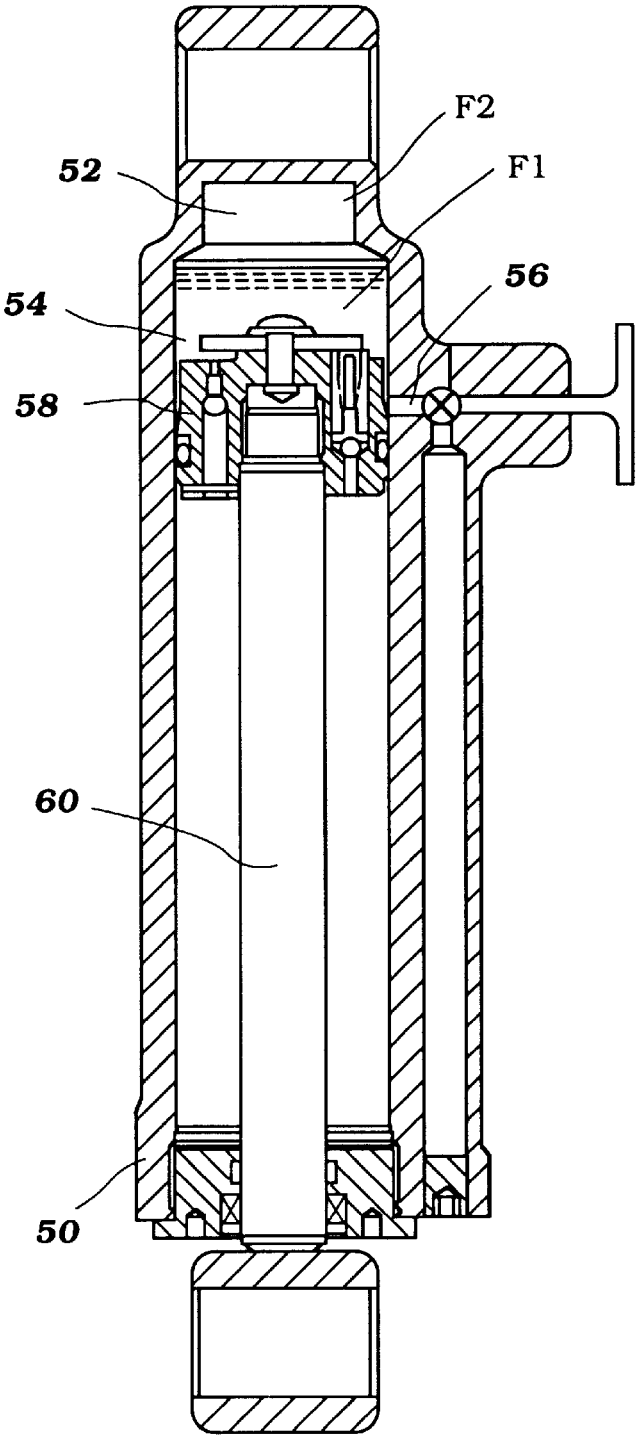
Figure 2 Prior Art
Figure 3:
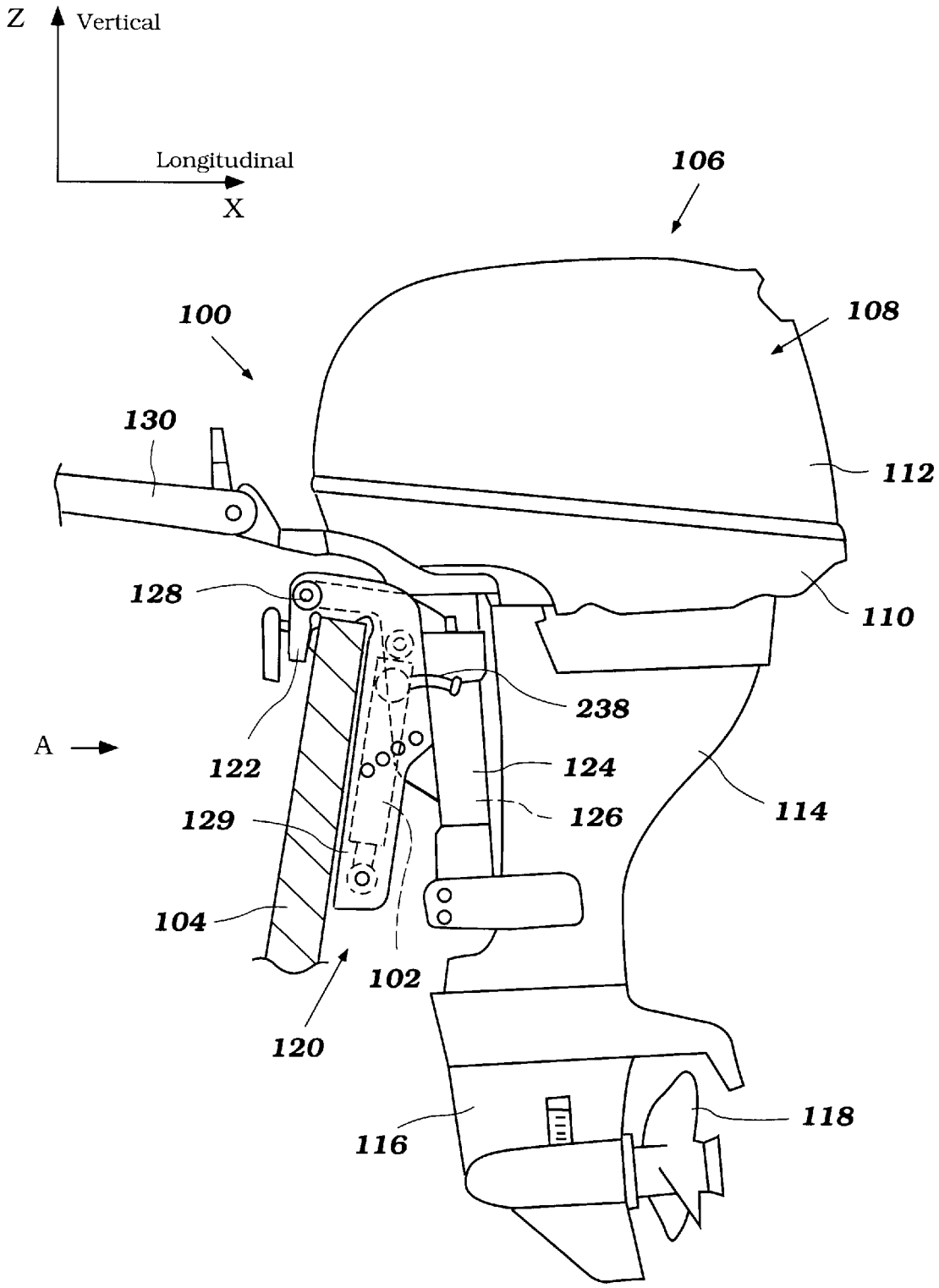
FIGS. 3 through 8 illustrate a preferred embodiment of the present tilt and trim system. The above-mentioned and other features of the invention will now be described with reference to this embodiment, which are intended to illustrate, but not to limit, the present invention. The following further describes the figures of this embodiment.

FIG. 3 illustrates an exemplary outboard motor 100 which incorporates a tilt and trim unit 102 configured in accordance with the present invention. Because the present tilt and trim unit has particular utility with an outboard motor, the following describes the tilt and trim unit in connection with such an outboard motor; however, the depiction of the invention in conjunction with an outboard motor is merely exemplary. Those skilled in the art will readily appreciate that the present tilt and trim adjustment system can be readily adapted for use with other types and sizes of marine drives.

In the illustrated embodiment, the tilt and trim unit 102 operates between the outboard motor 100 and a transom 104 of an associated watercraft. An exemplary outboard motor 100 is illustrated in FIG. 3, and the following will initially describe the outboard motor in order to provide the reader with an understanding of the illustrated environment of use.

The outboard motor 100 has a power head 106 which desirably includes an internal combustion engine. The internal combustion engine can have any number of cylinders and cylinder arrangements, and can operate on a variety of known combustion principles (e.g., on a two-stroke or a four-stroke principle).

A protective cowling assembly 108 surrounds the engine. The cowling assembly 108 includes a lower tray 110 and a top cowling 112. The tray 110 and the cowling 112 together define a compartment which houses the engine with the lower tray 110 encircling a lower portion of the engine.

The engine is mounted conventionally with its output shaft (i.e., a crankshaft) rotating about a generally vertical axis. The crankshaft drives a drive shaft, as known in the art. The drive shaft depends from the power head 106 of the outboard motor 100.

A drive shaft housing 114 extends downwardly from the lower tray and terminates in a lower unit 116. The drive shaft extends through the drive shaft housing 114 and is suitably journaled therein for rotation about the vertical axis.

The drive shaft continues into the lower unit 116 to drive a propulsion shaft through a transmission. The propulsion shaft drives a propulsion device 118 which the lower unit 116 supports.

In the illustrated embodiment, the propulsion device 118 comprises a propeller. The propulsion device, however, can take the form of a dual, counter-rotating propeller system, a hydrodynamic jet, or like propulsion device.

A coupling assembly 120 supports the outboard motor 100 on the watercraft transom 104 so as to position the propulsion device 118 in a submerged position with the watercraft resting on the surface of a body of water. The coupling assembly 120 is principally formed between a clamp bracket 122, a swivel bracket 124, a steering shaft 126, and a pivot pin 128.

The steering shaft 126 is affixed to the drive shaft housing 114 through upper and lower brackets. An elastic isolator connects each bracket to the drive shaft housing 114 (or to a section of the outboard motor connected to the drive shaft housing, e.g., an exhaust guide located beneath the engine). The elastic isolators permit some relative movement between the drive shaft housing 114 and the steering shaft 126 and contain damping mechanisms for damping engine vibrations transmitted from the drive shaft housing 114 to the steering shaft 126.

The steering shaft 126 is rotatably journaled for steering movement about a steering axis within the swivel bracket 124. A steering actuator 130 is attached to an upper end of the steering shaft 126 to steer the outboard motor 100, in a known manner. Movement of the actuator 130 rotates the steering shaft 126, as well as the drive shaft housing 114 which is connected through the upper and lower brackets about the steering axis.

The swivel bracket 124 includes a cylindrical housing through which the steering shaft 126 extends. A plurality of bearing assemblies journal the steering shaft 126 within the cylindrical housing. And as understood from FIG. 4, the swivel bracket 124 includes a pair of bracket arms 127 that are positioned in front of the cylindrical housing and project toward the clamping bracket 122.

The swivel bracket 124 also includes a pair of lugs which project forward toward the watercraft transom 104. Each lug includes a coupling hole at its front end. The coupling holes are aligned with each other along a common pivot axis.

As seen in FIG. 3, the clamping bracket 122 is affixed in a conventional manner to the transom 104. The clamping bracket 122 includes a support plate. The support plate abuts the outer surface of the transom 104 when the clamping bracket 122 is attached to the watercraft.

A pair of flanges 129 project toward the outboard motor 100 from the sides of the support plate, as seen in FIG. 3. The flanges 129 are spaced apart from each other by a sufficient distance to receive the swivel bracket 124 between the flanges. The flanges 129 also shield the space between the support plate and the cylindrical housing of the swivel bracket 124 to protect the inner components of the tilt and trim adjustment system 102, as appreciated from FIGS. 3 and 4.

The pivot pin 128 completes the hinge coupling between the clamping bracket 122 and the swivel bracket 124. The pivot pin 128 extends through the aligned coupling holes of the clamping bracket and the swivel bracket lugs and is fixed to the clamping bracket. The inner surfaces of the coupling holes through the swivel bracket lugs act as bearing surfaces as the swivel bracket 124 rotates about the pivot pin 128. The outboard motor 100 thus can be pivoted about the pivot axis defined by the pivot pin 128, through a continuous range of trim positions. In addition, the pivotal connection permits the outboard motor 100 to be trimmed up or down, as well as to be tilted up and out of the water for storage or transport, as known in the art.

The tilt and trim unit 102 operates between the clamping bracket 122 and the swivel bracket 124 to lock a manually established tilt or trim position of the outboard motor 100. While the present embodiment is described in the context of a hydraulic system, other types of working fluids (e.g., air, nitrogen) can also be used.

The tilt and trim unit 102 will now be described with additional reference to FIGS. 3 through 8. In order to describe the present system, a coordinate system is provided that includes a longitudinal axis X, a lateral axis Y, and a vertical axis Z. With the outboard motor positioned on a watercraft when afloat, the longitudinal axis X extends generally in the direction from bow to stem and parallel to the surface of the body of water in which the watercraft is floating, the lateral axis Y extends normal to the longitudinal axis and parallel to the water surface, and the vertical axis Z extends normal to both the longitudinal and lateral axes, as best understood from FIGS. 3 and 4.

Figure 4:
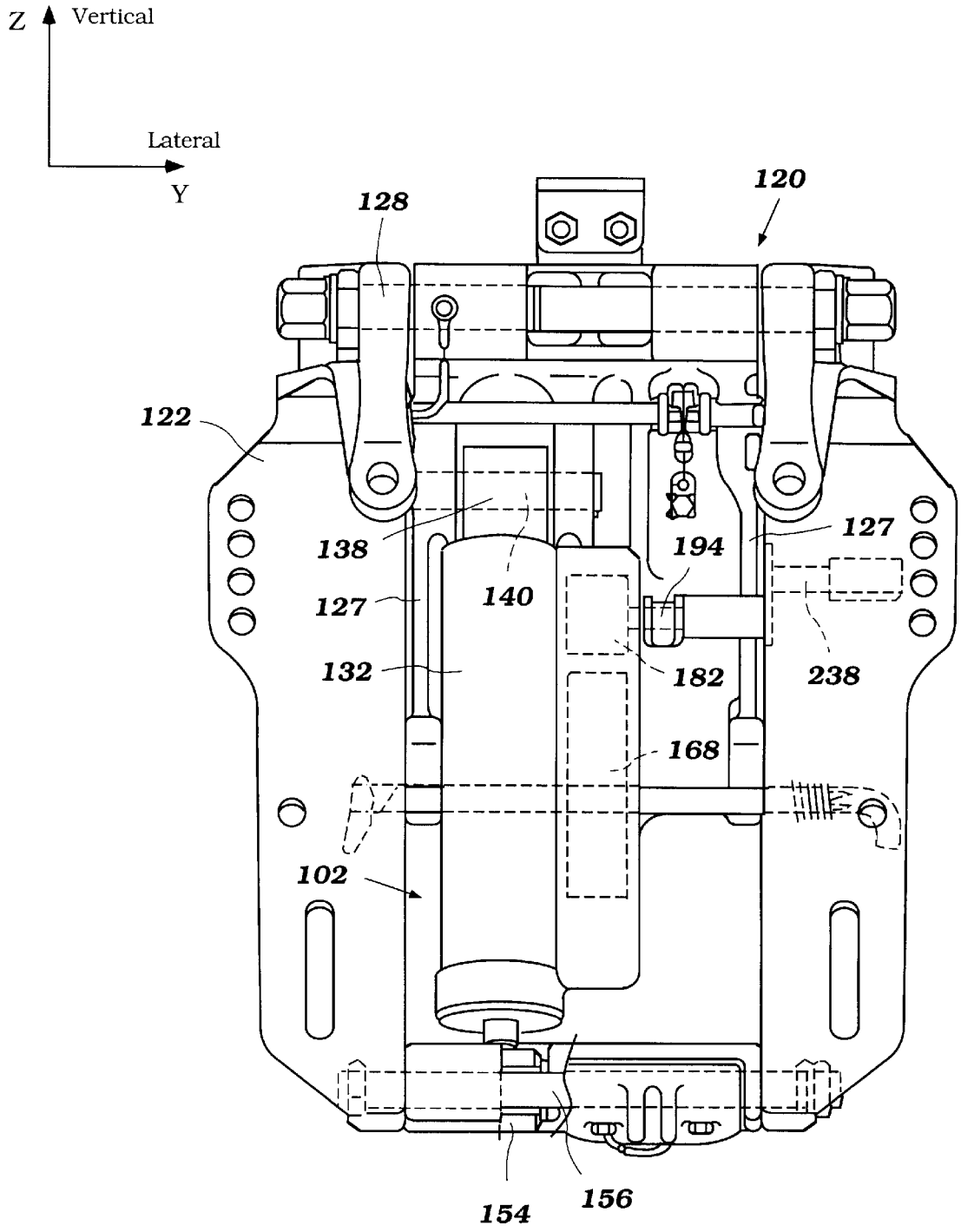
Figure 5:
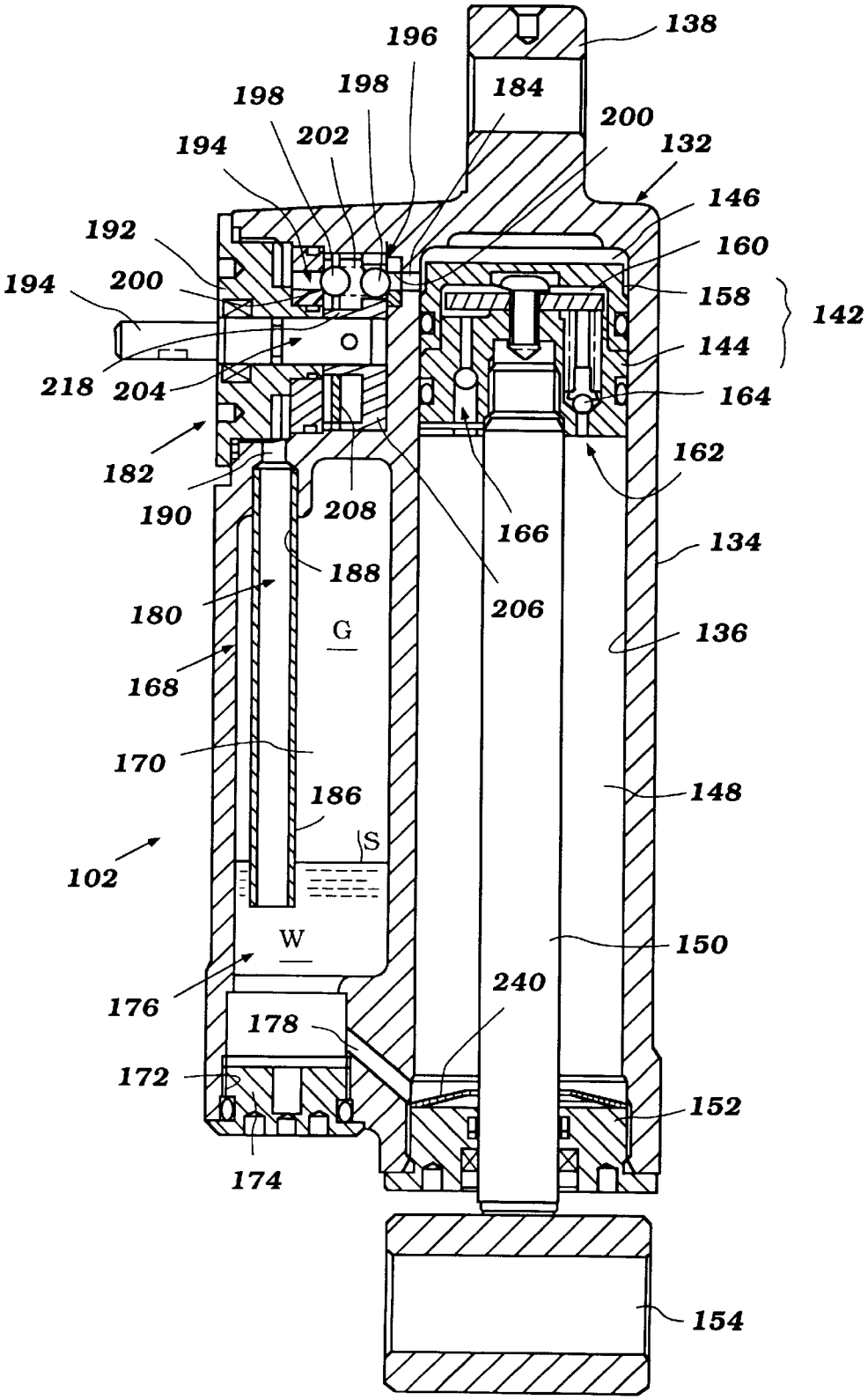

With reference principally to FIG. 5, the tilt and trim unit 102 includes a cylinder housing assembly 132 comprised of a main cylinder part 134 that defines a cylinder bore 136 extending in a generally vertical direction. The cylinder housing 134 is provided with a trunnion 138 having a bore that is adapted to receive a pivot pin 140 (FIG. 4) that passes between the sides of the swivel bracket 124 so as to pivotally connect the cylinder housing 132 to the swivel bracket 124.

A piston assembly 142 include a piston 144 that is slidably supported within the cylinder bore 136 and defines an upper chamber 146 and a lower chamber 148, both of which are filled with hydraulic fluid. A piston rod 150 is affixed to the piston 144 and extends through a closure plug 152 fixed in the lower end of the cylinder housing 132 for closing the cylinder bore 136. The projecting end of the piston rod 150 is provided with a trunnion 154 that receives a pivot pin 156 (FIG. 4) for pivotal connection to the clamping bracket 122.

A floating piston 158 of the piston assembly 142 is positioned in the upper chamber 146 and defines a further intermediate chamber 160 below the floating piston 158. The floating piston 158 normally engages the piston 144 in an abutting manner, and controls the upward position of the piston 144. The intermediate chamber 160 is also filled with hydraulic fluid.

An absorber valve, indicated generally by the reference numeral 162, is provided in the piston 144 for permitting flow from the lower chamber 148 to the intermediate chamber 160 when an underwater obstacle is struck with sufficient force. The absorber valve 162, however, requires sufficient force to open it so that it will not permit the outboard motor 100 to pop up when traveling in reverse. The absorber valve 162 is comprised of a passageway that extends from the lower chamber 148 and which is normally closed by a ball type valve 164 that is held in its closed position by means of a coil compression spring. The compression spring sets the pressure at which the absorber valve 162 will open.

A return valve, indicated generally by the reference numeral 166, is provided for permitting fluid flow from the intermediate chamber 160 back to the lower chamber 148 when the underwater obstacle is cleared. The return valve 166 is comprised of a passageway in the piston 144 in which a ball type check valve is positioned. The passageway extends between the lower and intermediate chambers 148, 160. A light return spring (not shown) holds the ball valve in its closed position but is adapted to open under relatively low pressures as exerted by the weight of the outboard motor 100 once the underwater obstacle is cleared. As understood from FIG. 3, a center of gravity of the outboard motor 100 is disposed rearwardly of the horizontal tilt axis defined by the pivot pin 128 so that the weight of the outboard motor 100 will tend to cause it to move downwardly.

Because the piston rod 150 extends in the lower chamber 148 and thus displaces some of the fluid from it, there will be less fluid displaced from the lower chamber 148 than is required to make up the volume in the upper chamber 146 as the piston 142 moves downward. To compensate for this change in fluid volume, an accumulator assembly, indicated generally by the reference numeral 168, is formed integrally with the cylinder housing 132. The accumulator assembly 168 comprises a sub-chamber 170 in which hydraulic fluid is positioned. In addition, a pressurized inert gas G, such as, for example, nitrogen, is charged in the chamber 170 over the working fluid W. If desired, adequate pressure may be stored in the sub-chamber 170 so as to provide some lift assistance during tilt up operation, as will become apparent. And, as illustrated in FIG. 5, an interface surface S is defined between the compressible gas G and the working fluid W.

An opening 172 is formed on the lower side of the cylinder housing 132 and opens into the sub-chamber 170. A plug 174 seals the opening 172 closed and defines a lower wall of the sub-chamber 170.

A bypass, which is generally designated by reference numeral 176, is provided for selectively bypassing the shock absorbing mechanism 162 of the tilt and trim unit 102 to permit manual movement of the outboard motor 100. In the illustrated embodiment, the sub-chamber 170 forms a portion of this bypass. The balance of the bypass is formed by a lower passage 178, a conduit 180, a valve assembly 182 and an upper passage 184, as understood from FIG. 5.

The lower passage 178 links the sub-chamber 170 with the lower fluid chamber 148 of the cylinder. In the illustrated embodiment, the lower passage 178 extends from a point near a lower wall of the lower chamber 148 to a point in the sub-chamber 170 just above the sealing plug 174.

A valve assembly 182 lies within the cylinder assembly 132 above the sub-chamber 170. One side of the valve assembly 182 communicates with the upper chamber 146 through the upper passage 184. The upper passage 184 desirably opens into the upper chamber 146 at a point near an upper end of the chamber. And as seen in FIG. 5, the floating piston 158 has a narrowed width to provide a fluid passage around the piston 158 within the upper chamber 146.

The other side of the valve 182 communicates with the sub-chamber 170 through the conduit 180. In the illustrated embodiment, the conduit 180 is formed in part by a stand pipe 186 that is arranged generally parallel to a stroke axis of the cylinder (i.e., parallel to an axis of the piston rod 150); however, the conduit 180 can have other orientations, as well as be integrally formed within the housing 132 of the cylinder assembly. The conduit 180, however, desirably communicates with the sub-chamber 170 at a point below the interface surface S regardless of the position of the piston assembly 142 within the cylinder bore 136. For instance, as illustrated in FIG. 5, a lower end of the stand pipe 186 terminates below the interface surface S even when the piston assembly 142 is moved to its uppermost position with the piston rod 150 fully retracted. This arrangement ensures that the conduit 180 always draws working fluid W, and not the compressible gas G.

As understood from FIG. 5, the stand pipe 186 is connected to an upper receptacle 188 through the lower opening 172 on the cylinder housing 132. This arrangement eases assembly and simplifies fabrication because the stand pipe 186 need not be integrally formed with the cylinder housing 132. The upper receptacle 188 is integrally formed in the cylinder housing 132 at the upper end of the sub-chamber 170, and communicates with a passage 190. The passage 190 and the stand pipe 186 together define the conduit 180 in the illustrated embodiment.

The valve assembly 182 operates between the upper passage 184 and an upper section of the conduit 180 (e.g., the passage 190). In the illustrated embodiment, the valve assembly 182 includes two ports: an upper port and a lower port. The upper port communicates with the upper passage 184, while the lower port communicates with the conduit 180. These ports are formed within a valve housing 192.

In the embodiment illustrated in FIG. 5, valve housing 192 generally has a cylindrical plug-like shape and is fit into a corresponding recess formed in the cylinder housing 132. The housing 192 defines a central bore in which a rotatable actuator shaft 194 rotates. The valve housing 132 also defines an internal passage that links the upper and lower ports.

A pair of valves 194, 196 are arranged to control fluid flow through the internal passage. The valves 194, 196 are arranged in series with one valve 194 constructed to prevent fluid flow in a direction from the upper chamber 146 to the lower chamber 148, and the other valve 196 constructed to prevent fluid flow in the opposite direction. For this purpose, each valve 194, 196 desirably is a one-way valve, and includes a valve element 198 and a corresponding valve seat 200. A common biasing member 202 urges each valve element 198 against the corresponding valve seat 200 to close the valve 194, 196. The valve seats 200 oppose each other with the valve elements 198 generally positioned between the valve seats 200 and the biasing element 202 interposed between the valve elements 198 in the valve assembly 182.

In the illustrated embodiment, each valve 194, 196 comprises a ball type check valve that includes a movable ball valve element 198. A compression spring 202, which functions as the biasing member, is arranged between the ball valve elements 198 of the valves 194, 196 and biases each ball valve element 198 against the corresponding valve seat 200. Other types of valve and valve elements, however, can also be used.

The valve assembly 182 also includes a valve actuator 204 formed in part by the actuator shaft 194. The actuator shaft 194 supports first and second cam members 206, 208 of the valve actuator 204, which each interact with one of the ball valve elements 198 as appreciated from FIG. 5. The first cam member 206 is fixed to the actuator shaft 194 to rotate with the shaft 194, while the second cam member 208 is rotatable supported by the actuator shaft 194, as will described in more detail below.

With reference to FIG. 6A, the first cam member 206 generally has a circular disc-like shape with a hole 210 that receives a portion of the corresponding ball valve element 198. The cam member 206 also includes a recess 212 of a given arc length that extends into body of the cam member 206 toward its center.

FIG. 6B illustrates the construction of the second cam member 208. Like the first cam member 206, the second cam member 208 also has a circular disc-like with a hole 214 that receives a portion of the other ball valve element 198. The cam member 208 also includes a recess 216 of a given arc length that extends into the body of the cam member 208 toward its center. The arc length of the recess 216 of the second cam member 208, however, is less than the arc length of the first cam member recess 212.

In the illustrated embodiment, as best seen in FIG. 5, the first cam member 206 includes a hub 218 with a bore that receives an end of the actuator shaft 194. The hub 218 also supports second cam member 208 at a location spaced from the first cam member disc. Both diameters of the first and second cam members 206, 208 are generally equal to a diameter of the bore of the cylinder housing 132 in which the valve assembly 182 is mounted.

A lost motion coupling, generally designated by reference numeral 220 in FIG. 6B, operates between the first and second cam members 206, 208 such that the first cam member 206 can rotate relative to the second cam member 208 over a first rotational range. The coupling 220, however, causes the first and second cam members 206, 208 to rotate together over a second rotational range.

In the illustrated embodiment, the lost motion coupling 220 is formed by a projection 222 on the first cam member which fits within an opening 224 in the second cam member 208. The projection 222 extends from an inner surface of the first cam member 206. The projection 222 includes an abutment edge 226 and a relief 228.

The opening 224 of the second cam member 208 is sized to receive the projection 222 of the first cam member 206. The opening 224 is larger than the projection 222 to permit relative movement between the first and second cam members 206, 208. An edge of the opening provides a contact surface 230 against which the abutment edge 226 of the projection 222 acts.

A biasing element 232 is arranged between the first and second cam members 206, 208 so as to bias the abutment edge 226 of the projection 222 toward the contact surface 230 of the second cam member 208. In the illustrated embodiment, the biasing member 232 is a compression spring arranged between the projection 222 and a side of the opening 224 that is generally opposite of the contact surface 230. The compression spring 232 fits within the relief 228 of the projection 222 and onto a spindle element 234 that projects into the opening 224 from the corresponding side. The biasing element, however, can take other forms, such as, for example, but without limitation, a torsion spring operating between the first and second cam members or between the second cam member and the actuator shaft.

With the projection 222 of the first cam member 206 positioned within the opening 224 of the second cam member 208, the recesses 212, 216 of the cam members 206, 208 generally overlap as viewed in the lateral direction. A stop element 236 is positioned within the recesses 212, 216 of the first and second cam members 206, 208 to limit the rotational movement of the cam members 206, 208, and thus the actuator shaft 194. In the illustrated embodiment, the stop element 236 comprises a cylindrical pin that extends generally parallel to the actuator shaft 194; however, other types of stops can also be used.

When assembled, as understood from FIGS. 5 and 6C, the first and second cam members 206, 208 lie generally parallel to each other and generally normal to the supporting actuator shaft 194. The ball valve elements 198 are contained within the corresponding holes 210, 214 in the cam members 206, 208 and are biased against the corresponding valve seat 200 by the compression spring 202. The compression spring 202 extends between the ball valve elements 198, through the space between the cam members 206, 208.

As best understood from FIGS. 3 and 4, a lever 238 is connected to the actuator shaft 194 to operate the valve 182. The lever 238 projects to one side of the tilt and trim unit 102, desirably beyond one side of the swivel bracket 124. In this position, the lever 238 can easily be rotated by a person to move the valve 182 between the plurality of valve positions described below.

With reference to FIG. 5, a biasing element 240 is arranged within the lower fluid chamber 148 and rests at a position against the end wall of the chamber 148. In the illustrated embodiment, the biasing element 240 generally has a disc-like shape, and can be configured like a belleville spring. The vertical dimension of the spring 240 desirably matches the vertical dimension of the port at the end of the lower passage 178. The spring 240 functions to urge the piston 142 away from the lower wall when the piston 142 moves from a position abutting the lower wall (i.e., from a fully extended, bottomed position).

The valve assembly 182 desirably has three operational states: a closed state; a one-way state; and an open state.

Figure 6:
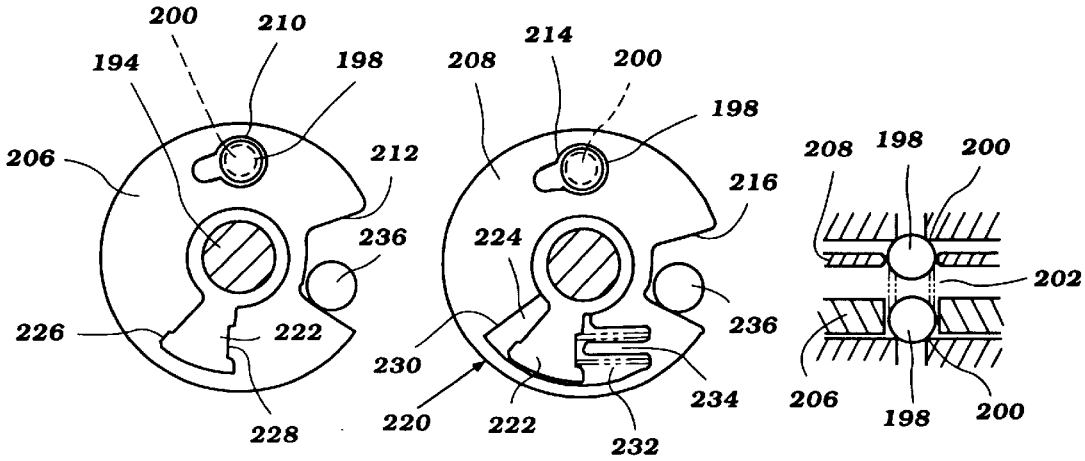
Figure 7:
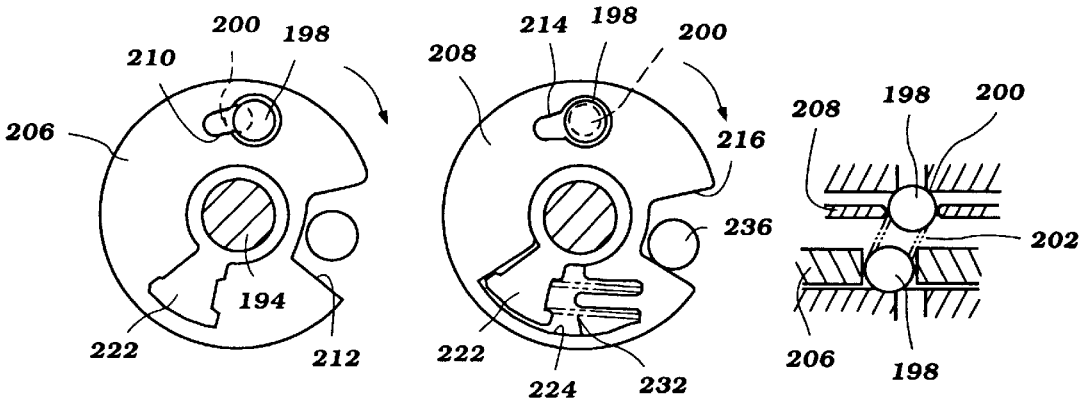
Figure 8:
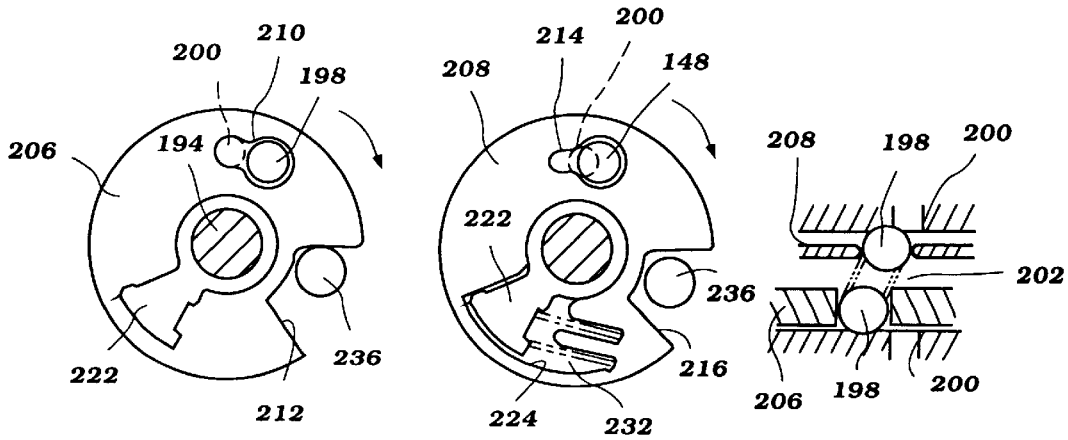

FIGS. 6 through 8 illustrate these states which will now be described in connection with the operation of the valve assembly.

With initial reference to FIGS. 6A through 6C, the components of the valve assembly 182 are illustrated in a closed position. As seen in FIGS. 6A and 6B, both cam members 206, 208 contact the stop element 23 as as to prevent further rotation (e.g., rotation in the counter-clockwise direction in the illustrated embodiment). In this position, the projection 222 of the first cam member 206 compresses the spring 232 against the opening wall of the second cam member 208. The biasing member 202 also forces the ball valve elements 198 to seat within the corresponding valve seat 200. The biasing element 202 is sufficiently stiff to inhibit the valves 194, 196 from opening even under the force of full throttle; however, it is understood that the spring constant could be selected to prevent automatic movement under some operating conditions.

FIGS. 7A through 7C illustrates the components of the valve assembly 182 in a position corresponding to the one-way state. Rotation of the actuator shaft 194 in a clockwise direction moves the first cam member 206 relative to the stop 236, as seen in FIG. 7A. The second cam member 208, however, does not follow this movement, as understood from FIG. 7B. That is, the first cam member 206 rotates relative to the second cam member 208 as the valve 182 is moved from the closed position to the one-way position. The projection 222 moves through the larger opening 224 of the second cam member 208 with the spring 232 expanding with this movement. Once this position is reached, the abutment edge 226 of the first cam member 206 contacts the contact surface 230 of the second cam member 208, with the spring 232 urging these corresponding elements to remain in contact.

As seen in FIGS. 7A and 7C, the first cam member 206 moves the corresponding ball valve element 198 to an unseated position, thereby opening the corresponding valve seat 200 of the second valve 196. The port to the upper fluid chamber 146 thus is opened. The biasing element 202, however, urges the other ball valve element 198 of the first valve 194 against the corresponding valve seat 200 so as to continue to function as a one-way valve to prevent fluid flow from the upper fluid chamber 146 to the sub-chamber 170.

With the valve assembly 182 in this state, a person can raise the outboard motor 100 with little encumbrance from the tilt and trim unit 102. Because the effective length of the biasing element 202 is increased, less spring force biases the one ball valve 194 closed. Thus, by manually pivoting the outboard motor 100 to raise the lower unit, the piston assembly 142 moves downward to extend the piston rod 150. This action forces fluid from the lower chamber 148 and draws fluid into the upper chamber 146. The one-way valve 194 easily opens with the reduced spring force under this condition, and working fluid flow through the other valve 196, which is opened by the first cam member 206, into the upper chamber.

FIGS. 8A through 8C illustrate the valve components in an open state. Further clockwise rotation of the actuator shaft 194 from the one-way position toward the open position rotates the first and second cam members 206, 208 together. Under the force of the spring 232, the second cam member 208 follows the movement of the first cam member 206. The stop 136 contacts the edges of the aligned recesses 212, 216 of the first and second cam members 206, 208 to establish the open position. The stop 236 prevents further rotation of the cam members 206, 208 in the clockwise direction.

As seen in FIGS. 8A and 8C, the first cam member 206 moves the corresponding ball valve element 196 to further away from the corresponding valve seat 200 to hold the valve 196 open. The port to the upper fluid chamber 146 thus remains open. And as seen in FIGS. 8B and 8C, the second cam member 208 moves the corresponding ball valve element 198 to a position unseating the ball valve element 198 from its respective valve seat 200 of the first valve 194. The internal passage within the valve assembly 182 thus is opened to allow free communication between the upper chamber 146 and the sub-chamber 170, and thus between the upper and lower chambers 146, 148. With the valve assembly 182 in this state, a person can freely raise or lower the outboard motor 100 with minimal affect from the tilt and trim unit 102.

To move the valve 182 in the opposite direction, the actuator shaft 194 rotates in a counter-clockwise direction. The second cam member 208 follows the first cam member 206 between the open position to the one-way position because the spring 232 urges the second cam member 208 to follow the first cam member 206. Once in the one-way position, as seen in FIG. 7B, the stop 236 prevents further counter-clockwise rotation of the second cam member. The first cam member 206 can rotate further, however, due to the lost motion coupling 220 between the cam members 206, 208. As the first cam member 206 rotates in the counter-clockwise direction, the spring 232 between the cam members 206, 208 is compressed with the projection 22 moving within the opening 224 of the second cam member 208. The stop 236 prevents further counter-clockwise rotation of the first cam member 206 once the closed position is reached. In both the closed and one-way positions, the cam members 206, 208 hold the corresponding ball valve elements 198 in the above described positions.

This valve design thus eases manual tilt up of the outboard motor. The person raising the lower unit of the outboard motor can initially position the valve assembly in the one-way position to allow the person to release the outboard motor once a desired tilt or trim position has been established. The person can then move the valve to the closed position to hold the outboard motor in the desired position.

The configuration of the cylinder assembly additionally integrated this improved valve design into a compact package. The arrangement of the sub-chamber and valve assembly in series with the valve assembly positioned above the sub-chamber also aids this purpose. The alignment of the sub-chamber directly beneath the valve assembly, with these components generally parallel to the cylinder, also contributes to the overall small size of the tilt and trim unit. The tilt and trim unit consequently can fit between the swivel and clamping brackets without requiring reinforcement of the arms of these brackets.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A tilt and trim unit for a marine drive comprising an actuator including a first variable volume fluid chamber and a second variable volume fluid chamber separated by a piston that moves along a stroke axis of the actuator, the first and second fluid chambers communicating with each other through a valve mechanism, and a sub-chamber connected to the first fluid chamber and containing at least a compressible fluid, the sub-chamber and the valve mechanism being arranged next to the actuator on the same side of the actuator stroke axis and directly above one another.

2. A tilt and trim unit as in claim 1, wherein the valve mechanism is arranged next to the second fluid chamber, and the sub-chamber is arranged next to the first fluid chamber below the valve mechanism.

3. A tilt and trim unit as in claim 1, wherein the second fluid chamber is arranged generally above the first fluid chamber, and the valve mechanism is arranged above the sub-chamber such that the valve mechanism and the sub-chamber are arranged generally parallel to the stroke axis of the actuator.

4. A tilt and trim unit as in claim 3, wherein the valve mechanism communicates with the sub-chamber through a stand pipe.

5. A tilt and trim unit as in claim 1 additionally comprising an elastic member arranged between an end of the actuator, within one of the fluid chambers, and the piston.

6. A tilt and trim unit as in claim 1, wherein the valve mechanism includes a pair of one-way valves positioned in series with one valve arranged to prevent fluid flow in a first direction and the other valve arranged to prevent fluid flow in an opposite second direction.

7. A tilt and trim unit as in claim 6, wherein each one-way valve includes a valve element that cooperates with a corresponding valve seat, and a common biasing member biases the valve elements of the one-way valves against their respective valve seats.

8. A tilt and trim unit as in claim 7, wherein the valve mechanism additionally includes a valve actuator to move each valve element independent of the other, and the valve actuator includes a first cam member fixed to a rotational shaft, and a second cam member arranged to rotate about an axis of the shaft and coupled to the first cam member by a lost motion coupling, the first cam member arranged to act upon the valve element of one of the one-way valves, and the second cam member arranged to act upon the valve element of the other of the one-way valves.

9. A tilt and trim unit for a marine drive comprising a cylinder including a first variable-volume fluid chamber and a second variable-volume fluid chamber separated by a moveable piston, the first and second fluid chambers communicating with each other through a passage, and a valve mechanism positioned within the passage to establish a plurality of flow conditions through the passage, the valve mechanism including first and second valves operable to establish the plurality of flow conditions through the valve mechanism, each valve including a valve seat and a valve element biased against the corresponding valve seat, the valves being arranged such that under at least one of the flow conditions the first valve allows fluid flow through the passage in a first flow direction which is opposite to a second flow direction inhibited by the second valve, a valve actuator having a first rotational cam member that cooperates with the valve element of the first valve to move the valve element between an open position and a closed position, and a second rotational cam member that cooperates with the valve element of the second valve to move the valve element between an open position and a closed position.

10. A tilt and trim unit as in claim 9, wherein the valve actuator additionally includes a rotatable shaft to which the first cam member is fixed, and the second cam member is coupled to the first cam member and is arranged to rotate about an axis of the shaft so as to rotate with the first cam member through a first range of rotation in at least one rotational direction.

11. A tilt and trim unit as in claim 10, wherein the valve actuator additionally includes a lost motion coupling operating between the first and second cam members such that the first cam member can rotate relative to the second cam member through a second range of rotation in at least one rotational direction.

12. A tilt and trim unit as in claim 11, wherein the valve actuator additionally comprises a stop that limits the rotational movement of both cam members.

13. A tilt and trim unit as in claim 11, wherein the first cam member and the second cam member are arranged to establish a closed flow condition in which the valve elements of both valves are simultaneously in the closed position, to establish a one-way flow condition in which the valve element of one valve is open and the valve-element of the other valve is closed, and to establish an open flow condition in which the valve elements of both valves are simultaneously in the open position.

14. A tilt and trim unit for a marine drive comprising a cylinder including a first variable-volume fluid chamber and a second variable-volume fluid chamber separated by a movable piston, a sub-chamber freely communicating with the first fluid chamber and communicating with the second fluid chamber through a valve mechanism, the sub-chamber being disposed apart from the first and second fluid chambers, the sub-chamber comprising a volume of working fluid and a volume of compressible fluid occupying a space above the working fluid, both the first and second chambers of the cylinder communicating with the sub-chamber at a point below an interface surface between the working fluid and the compressible fluid.

15. A tilt and trim unit as in claim 14 additionally comprising a conduit connected to the valve mechanism and extending through at least a portion of the space occupied by the compressible fluid and terminating at a point below the interface surface.

16. A tilt and trim unit as in claim 15, wherein the conduit lies generally parallel to a stroke axis along which the piston moves.

17. A tilt and trim unit as in claim 14 additionally comprising a passage connecting the first fluid chamber to the sub-chamber, an opening between the passage and the first fluid chamber being located next to an end wall of the first fluid chamber, and an elastic member being arranged between the end wall and the piston.

18. A tilt and trim unit as in claim 17 additionally comprising a cylinder rod connected to the piston and extending through and beyond the end wall of the first fluid chamber.

19. A tilt and trim unit as in claim 14, wherein the first and second fluid chambers, the sub-chamber, and the valve mechanism are formed within a unitary housing.

20. A tilt and trim unit as in claim 19, wherein the valve mechanism is arranged next to at least a portion of the second fluid chamber, and the sub-chamber is arranged next to at least a portion of the first fluid chamber and generally beneath the valve mechanism.

21. A tilt and trim unit as in claim 20, wherein an opening into the sub-chamber is located on a side of the sub-chamber opposite of the valve mechanism, and a plug closes the opening.

22. A tilt and trim unit as in claim 21 additionally comprising a conduit connected to a port of the valve mechanism, extending through at least a portion of the space occupied by the compressible fluid, and terminating at a point below the interface surface, and the port of the valve mechanism being positioned so as to be accessible through the opening into the sub-chamber.

23. A tilt and trim unit for a marine drive comprising an actuator including a first variable volume fluid chamber and a second variable volume fluid chamber separated by a piston that moves along a stroke axis of the actuator, the second fluid chamber being arranged generally above the first fluid chamber, a sub-chamber connected to the first fluid chamber, a valve mechanism arranged generally above the sub-chamber and connected to the second fluid chamber, and the valve mechanism communicating with the sub-chamber through a stand pipe.

24. A tilt and trim unit in claim 23, wherein a working fluid fills the first and second fluid chambers and the valve mechanism, the working fluid occupies a portion of the sub-chamber, a compressible fluid occupies the rest of the sub-chamber, and the stand pipe communicates with the sub-chamber at a point below an interface between the compressible fluid and the working fluid so that only the working fluid flows through the stand pipe.

25. A tilt and trim unit for a marine drive comprising an actuator including a first variable volume fluid chamber and a second variable volume fluid chamber separated by a piston that moves along a stroke axis of the actuator, the first and second fluid chambers communicating with each other through a valve mechanism, the valve mechanism including a pair of one-way valves and a valve actuator, each one-way valve including a valve element, the valve actuator being arranged to move each valve element independent of the other, the valve actuator including a first cam member fixed to a rotational shaft and a second cam member arranged to rotate about an axis of the shaft and coupled to the first cam member by a lost motion coupling, the first cam member being arranged to act upon the valve element of one of the one-way valves, and the second cam member being arranged to act upon the valve element of the other of the one-way valves.

26. A tilt and trim unit for a marine drive comprising a cylinder including a first variable-volume fluid chamber and a second variable-volume fluid chamber separated by a movable piston, the first and second fluid chambers communicating with each other through a passage, and a valve mechanism positioned within the passage to establish at least a plurality of flow conditions through the passage, the valve mechanism including first and second valves, each valve including a valve seat and a valve element biased against the corresponding valve seat, the valve mechanism additionally including a valve actuator including a first rotational cam member that cooperates with the valve element of the first valve to move the valve element between an open position and a closed position, and a second rotational cam member that cooperates with the valve element of the second valve to move the valve element between an open position and a closed position.

27. A tilt and trim unit for a marine drive comprising a cylinder including a first variable-volume fluid chamber and a second variable-volume fluid chamber separated by a movable piston, a sub-chamber freely communicating with the first fluid chamber and communicating with the second fluid chamber through a valve mechanism, the sub-chamber comprising a volume of working fluid and a volume of compressible fluid occupying a space above the working fluid, both the first and second chambers of the cylinder communicating with the sub-chamber at a point below an interface surface between the working fluid and the compressible fluid, the valve mechanism being arranged next to at least a portion of the second fluid chamber, the sub-chamber being arranged next to at least a portion of the first fluid chamber and generally beneath the valve mechanism, and a conduit connected to a port of the valve mechanism, the conduit extending through at least a portion of the space occupied by the compressible fluid and terminating at a point below the interface surface.

28. A tilt and trim unit as in claim 27, wherein an opening into the sub-chamber is located on a side of the sub-chamber opposite of the valve mechanism, and the port of the valve mechanism is positioned so as to be accessible through the opening into the sub-chamber.

* * * * *

UNITED STATES PATENT AND TRADEMARK OFFICE

CERTIFICATE OF CORRECTION

PATENT NO. : 6,213,822 B1
DATED : April 10, 2001
INVENTOR(S) : Saito et al.

It is certified that error appears in the above-identified patent and that said Letters Patent is hereby corrected as shown below:

Title page,
Item [75], Inventors, should read -- Hideki Saito of Kakegawa, Shizuoka (JP)
Daisuke Nakamura of Hamamtsu, Shizuoka (JP) --

Signed and Sealed this

Tenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,213,822 B1
DATED : April 10, 2001
INVENTOR(S) : Saito et al.

It is certified that error appears in the above-identified patent and that said Letters Patent is hereby corrected as shown below:

Title page,
Item [73], should read:
-- [73], Assignee: Sanshin Kogyo Kabushiki Kaisha of Hamamatsu, Shizuoka (JP) SOQI Kabushiki Kaisha of Kakegawa, Shizuoka (JP) --

Signed and Sealed this

Twelfth Day of November, 2002

*Attest:*

*Attesting Officer*

JAMES E. ROGAN
*Director of the United States Patent and Trademark Office*